US009529322B2

(12) United States Patent
Sambe

(10) Patent No.: US 9,529,322 B2
(45) Date of Patent: Dec. 27, 2016

(54) IMAGE FORMING APPARATUS WITH ADJUSTABLE VENT HOLE LOCATION

(71) Applicant: FUJI XEROX CO., LTD., Tokyo (JP)

(72) Inventor: Naoki Sambe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/885,470

(22) Filed: Oct. 16, 2015

(65) Prior Publication Data

US 2016/0306321 A1 Oct. 20, 2016

(30) Foreign Application Priority Data

Apr. 20, 2015 (JP) ..... 2015-085800

(51) Int. Cl.

| | |
|---|---|
| ***G03G 21/00*** | (2006.01) |
| ***G03G 21/20*** | (2006.01) |
| ***F24F 13/24*** | (2006.01) |
| ***F24F 13/08*** | (2006.01) |

(52) U.S. Cl.

CPC ..... *G03G 21/206* (2013.01); *F24F 13/084* (2013.01); *F24F 13/24* (2013.01); *F24F 2013/242* (2013.01); *G03G 2221/1645* (2013.01)

(58) Field of Classification Search

CPC ..... G03G 21/206; G03G 2221/1645; F24F 13/24; F24F 13/20; F24F 13/08; F24F 13/084; F24F 2013/242

USPC 399/92; 49/465; 454/347, 358, 367; 165/59, 165/75; 137/338; 174/547; 361/679.01, 361/679.49, 679.51, 690, 695, 692

See application file for complete search history.

(56) References Cited

U.S. PATENT DOCUMENTS

| | | | | |
|---|---|---|---|---|
| 4,066,061 A * | 1/1978 | Wolford | F24B 1/191 | 126/516 |
| 4,318,338 A * | 3/1982 | Felter | E06B 7/082 | 454/282 |
| 6,198,627 B1 * | 3/2001 | Roehling | G06F 1/181 | 361/679.33 |
| 7,322,881 B2 * | 1/2008 | Ishii | B41J 2/1408 | 399/92 |
| 2005/0086972 A1 * | 4/2005 | Hansen | F24F 13/20 | 62/407 |
| 2012/0240534 A1 * | 9/2012 | Ryuzaki | G03G 21/206 | 55/385.4 |

FOREIGN PATENT DOCUMENTS

| | | | |
|---|---|---|---|
| JP | 61072951 A | * | 4/1986 |
| JP | H10-336958 A | | 12/1998 |
| JP | 11141914 A | * | 5/1999 |
| JP | 2003-078268 A | | 3/2003 |
| JP | 2005-024984 A | | 1/2005 |
| JP | 4522871 B2 | | 8/2010 |

* cited by examiner

*Primary Examiner* — Robert Beatty
(74) *Attorney, Agent, or Firm* — Oliff PLC

(57) ABSTRACT

An image forming apparatus includes an exterior member attached to an apparatus body in such a manner as to cover an opening of the apparatus body. The opening allows air in the apparatus body to be exhausted to an outside. The exterior member has a vent hole that allows the air to flow through the exterior member. The exterior member is invertible upside down.

5 Claims, 6 Drawing Sheets

IMAGE FORMING APPARATUS WITH ADJUSTABLE VENT HOLE LOCATION

CROSS-REFERENCE TO RELATED APPLICATIONS

This application is based on and claims priority under 35 USC 119 from Japanese Patent Application No. 2015-085800 filed Apr. 20, 2015.

BACKGROUND

Technical Field

The present invention relates to an image forming apparatus.

SUMMARY

According to an aspect of the invention, there is provided an image forming apparatus including an exterior member attached to an apparatus body in such a manner as to cover an opening of the apparatus body. The opening allows air in the apparatus body to be exhausted to an outside. The exterior member has a vent hole that allows the air to flow through the exterior member. The exterior member is invertible upside down.

BRIEF DESCRIPTION OF THE DRAWINGS

An exemplary embodiment of the present invention will be described in detail based on the following figures, wherein.

DETAILED DESCRIPTION

The drawings to be referred to in the following description are only schematic, and individual elements illustrated therein are not necessarily scaled in accordance with their actual sizes. For easy understanding, irrelevant elements are not illustrated.

(1) Overall Configuration and Operation of Image Forming Apparatus

Figure 1B:
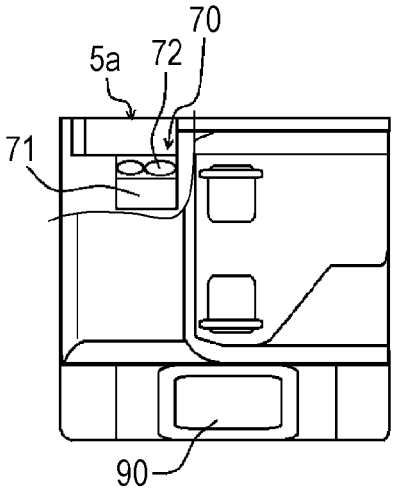
FIG. 1B is a partially sectional plan view of the image forming apparatus.
Figure 1C:
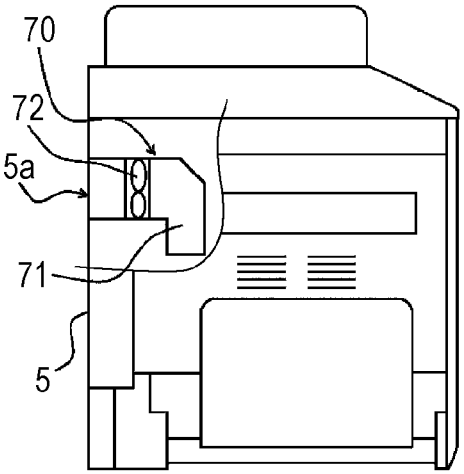
FIG. 1C is a partially sectional left-side view of the image forming apparatus.
Figure 1A:
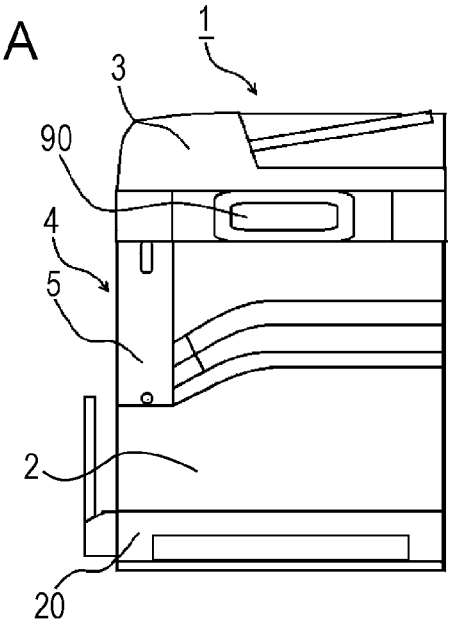
FIG. 1A is a schematic external front view of an image forming apparatus.
Figure 1D:
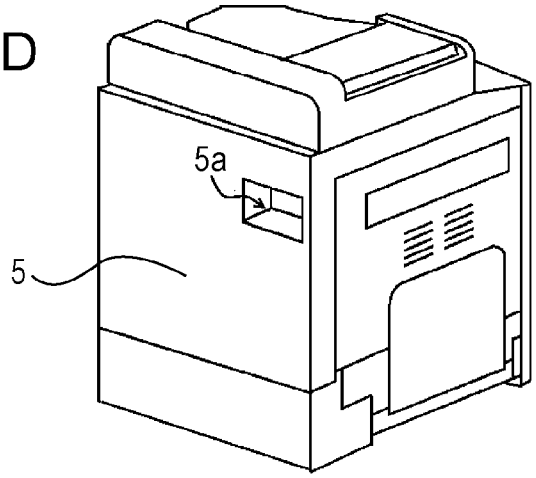
FIG. 1D is a rear perspective view of the image forming apparatus with an exterior member removed.
Figure 2:
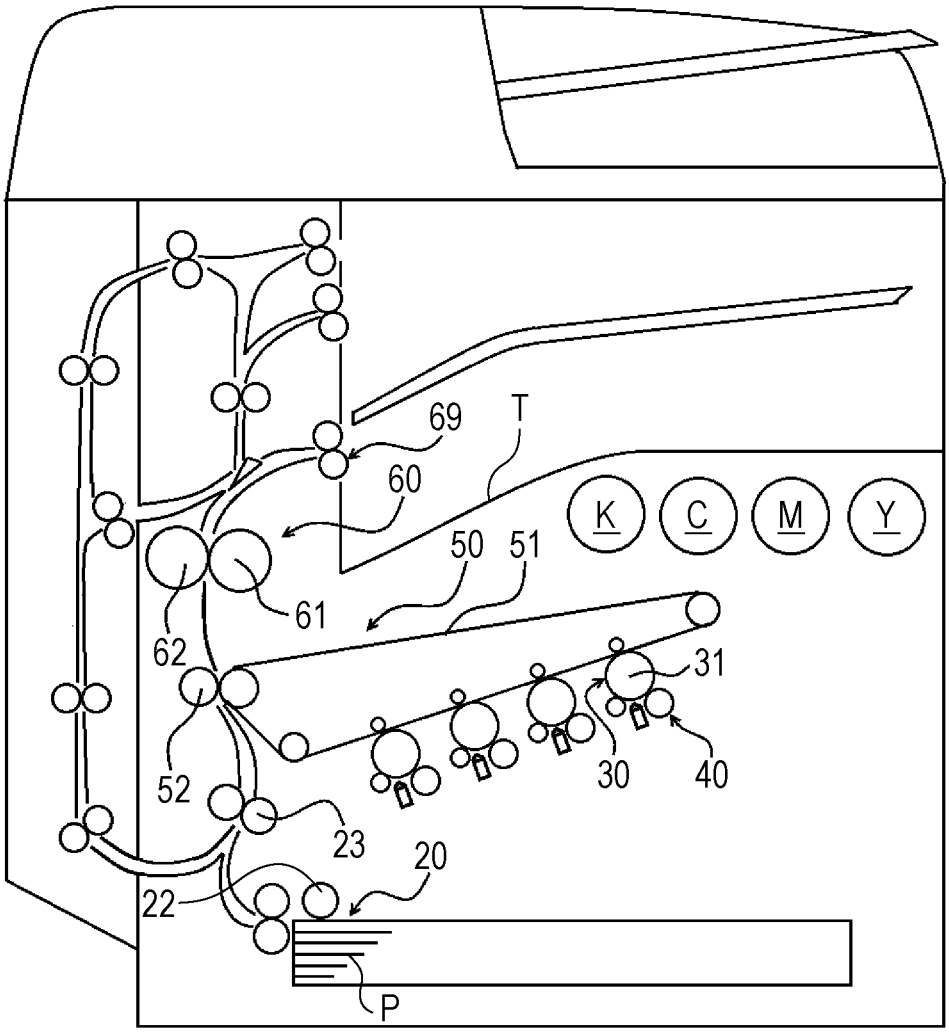
FIG. 2 is a sectional front view of the image forming apparatus and illustrates an internal configuration thereof.
Figure 3A:
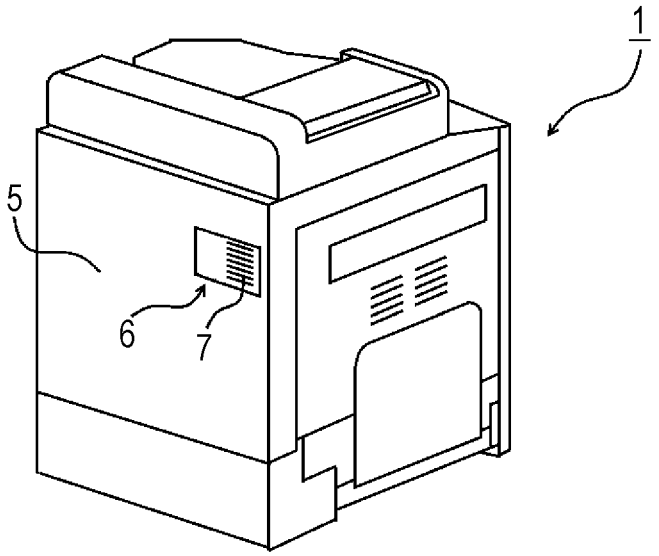
FIG. 3A is a rear perspective view of the image forming apparatus with the exterior member attached thereto in a first mode.
Figure 3B:
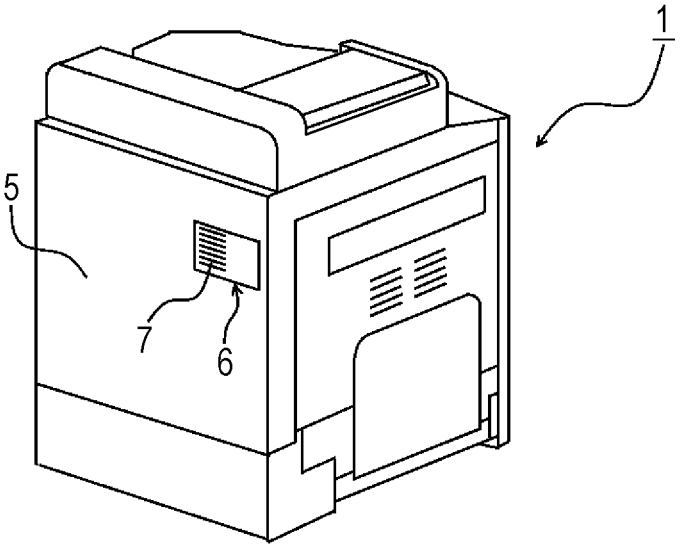
FIG. 3B is a rear perspective view of the image forming apparatus with the exterior member attached thereto in a second mode.

FIG. 1A is a schematic external front view of an image forming apparatus 1. FIG. 1B is a partially sectional plan view of the image forming apparatus 1. FIG. 1C is a partially sectional left-side view of the image forming apparatus 1. FIG. 1D is a rear perspective view of the image forming apparatus 1 with an exterior member 6 removed. FIG. 2 is a sectional front view of the image forming apparatus 1 and illustrates an internal configuration thereof. FIG. 3A is a rear perspective view of the image forming apparatus 1 with the exterior member 6 attached thereto in a first mode. FIG. 3B is a rear perspective view of the image forming apparatus 1 with the exterior member 6 attached thereto in a second mode.

The overall configuration and operation of the image forming apparatus 1 will now be described with reference to the drawings.

(1.1) Overall Configuration

The image forming apparatus 1 includes an image forming unit 2 that electrophotographically forms an image, and a reading unit 3 that reads a document or the like. The reading unit 3 is supported above the image forming unit 2 by a reading-unit-supporting portion 4.

The image forming unit 2 includes a housing (not illustrated), in which a sheet feeding device 20, photoconductor units 30, developing devices 40, a transfer device 50, a fixing device 60, and an exhaust device 70 (illustrated in FIGS. 1C and 1D) are provided. The housing is formed of plural separate exterior covering members 5.

The image forming unit 2 includes the exhaust device 70 (illustrated in FIGS. 1C and 1D). The exhaust device 70 includes an air duct 71 and an exhaust fan 72 provided in the air duct 71. The air duct 71 is provided in the housing and extends toward the rear side of the image forming apparatus 1. When the exhaust fan 72 is rotated, heated air in the image forming unit 2 is exhausted to the outside of the image forming apparatus 1 from an opening 5*a* provided in one of the exterior covering members 5.

The opening 5*a* is covered with an exterior member 6. The exterior member 6 has vent holes 7 that allow air exhausted by the exhaust fan 72 to flow through the exterior member 6. The orientation of the exterior member 6 with respect to an apparatus body is invertible upside down (see FIGS. 3A and 3B).

The reading unit 3 is provided on the front face thereof with an operation information portion 90 as a user interface. The operation information portion 90 is a combination of a liquid-crystal display panel, operation buttons, a touch panel, and so forth. The user of the image forming apparatus 1 inputs associated settings and instructions into the image forming apparatus 1 through the operation information portion 90. Furthermore, associated pieces of information are displayed to the user of the image forming apparatus 1 through the liquid-crystal display panel.

(1.2) Image Forming Unit

The image forming unit 2 is provided at the bottom thereof with the sheet feeding device 20, in which a number of sheets P as recording media are stacked. The sheets P whose position in the width direction is determined by a regulating plate (not illustrated) are picked up one by one from the top of the stack by a pickup member 22 toward the left side. The sheet P thus picked up is transported to a nip part between a pair of registration rollers 23.

The photoconductor units 30 are arranged side by side above the sheet feeding device 20 and include respective photoconductor drums 31 that are driven to rotate. The developing devices 40 form toner images in colors of yellow (Y), magenta (M), cyan (C), and black (K) on the photoconductor drums 31, respectively.

The toner images in the different colors that have been formed on the photoconductor drums 31 of the photoconductor units 30 are sequentially electrostatically transferred to an intermediate transfer belt 51 of the transfer device 50 (in first transfer), whereby the toner images are superposed one on top of another. The toner images superposed on the intermediate transfer belt 51 are collectively transferred by a second transfer roller 52 to the sheet P fed from the pair of registration rollers 23 and guided to the second transfer roller 52 by a transport guide (not illustrated).

The sheet P to which the toner images have been collectively transferred by the transfer device 50 is transported to the fixing device 60 with the toner images unfixed. The unfixed toner images are fixed under pressure and heat applied thereto by a combination of a heating module 61 and a pressing module 62.

The sheet P having the fixed toner images is guided to a pair of discharge rollers 69 by a transport guide (not illustrated) and is discharged by the pair of discharge rollers 69 onto a discharge tray T provided at the top of the image forming unit 2.

Thus, the image forming apparatus 1 has a C-shaped sheet transport path extending from the sheet feeding device 20 to the pair of discharge rollers 69 via the second transfer roller 52. Such a C-shaped sheet transport path minimizes the length of the path for transporting the sheet P and also minimizes the first printout time (FPOT).

(2) Configuration and Operation of Exterior Member

Figure 4A:
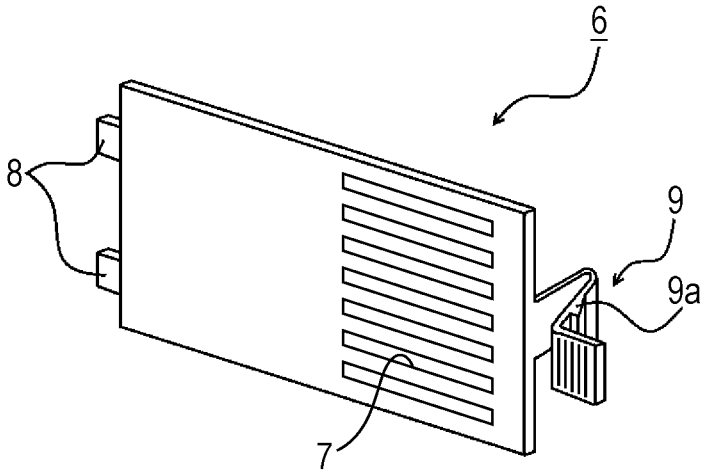
FIG. 4A is a perspective view of the exterior member that is seen from the outer side thereof.
Figure 4B:
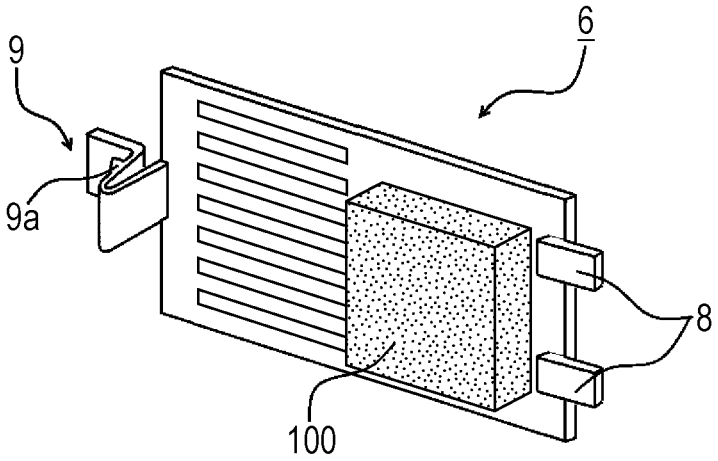
FIG. 4B is a perspective view of the exterior member that is seen from the inner side thereof.
Figure 5A:
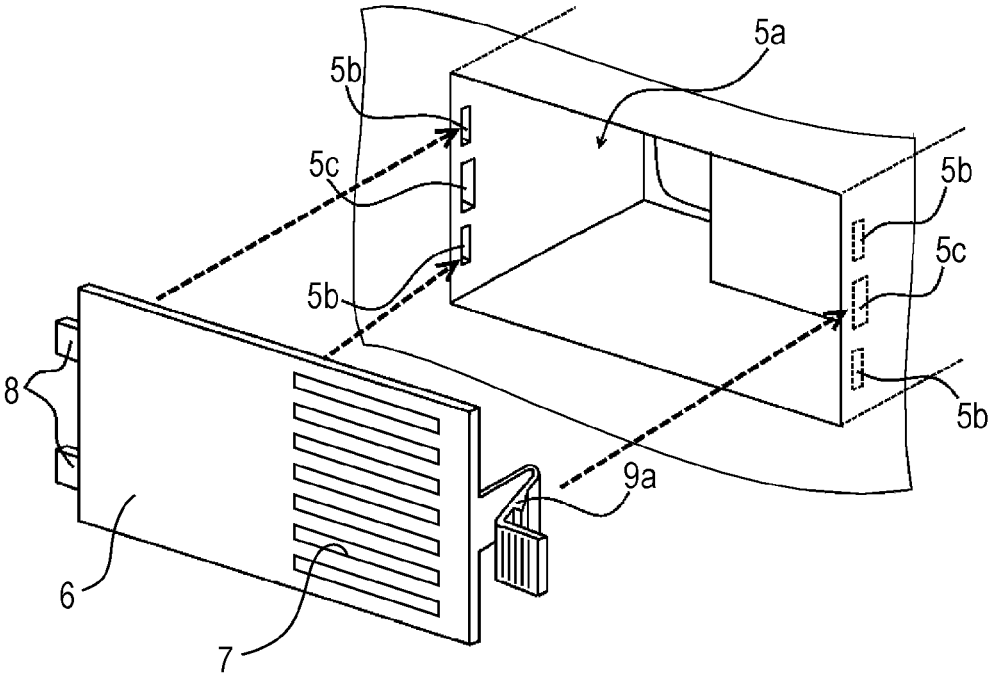
FIG. 5A is a perspective view of the exterior member that is to be attached to an apparatus body in the first mode.
Figure 5B:
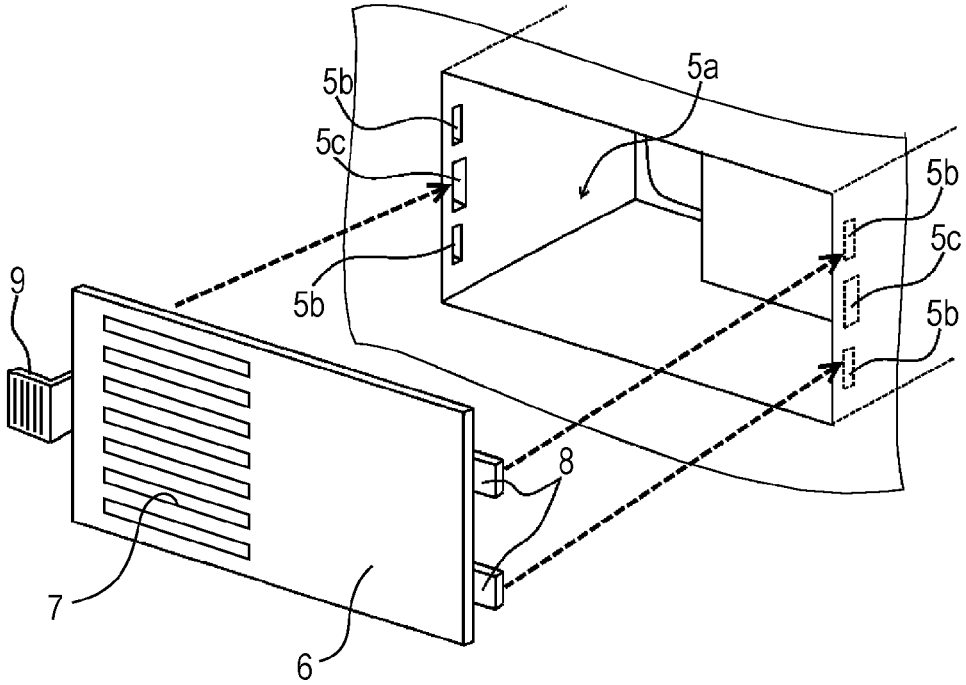
FIG. 5B is a perspective view of the exterior member that is to be attached to the apparatus body in the second mode.
Figure 6:
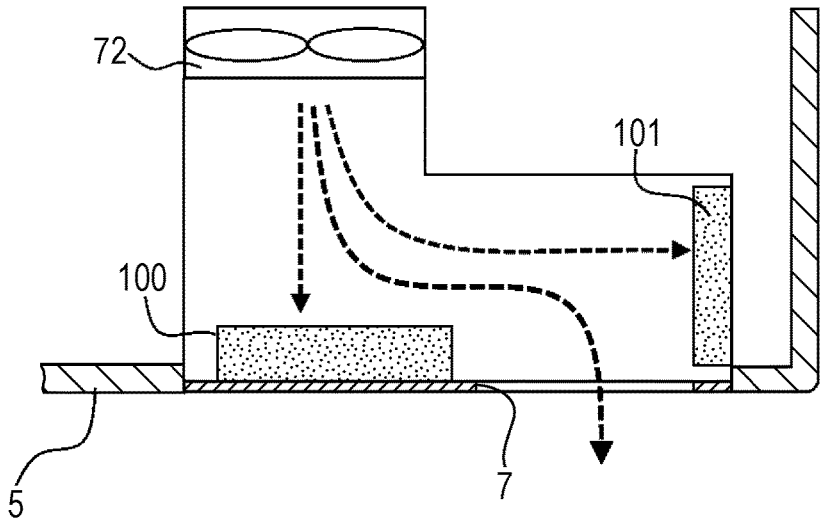
FIG. 6 is a schematic sectional view of the apparatus body and illustrates flows of air in a case where the exterior member is attached thereto in the first mode.
Figure 7:
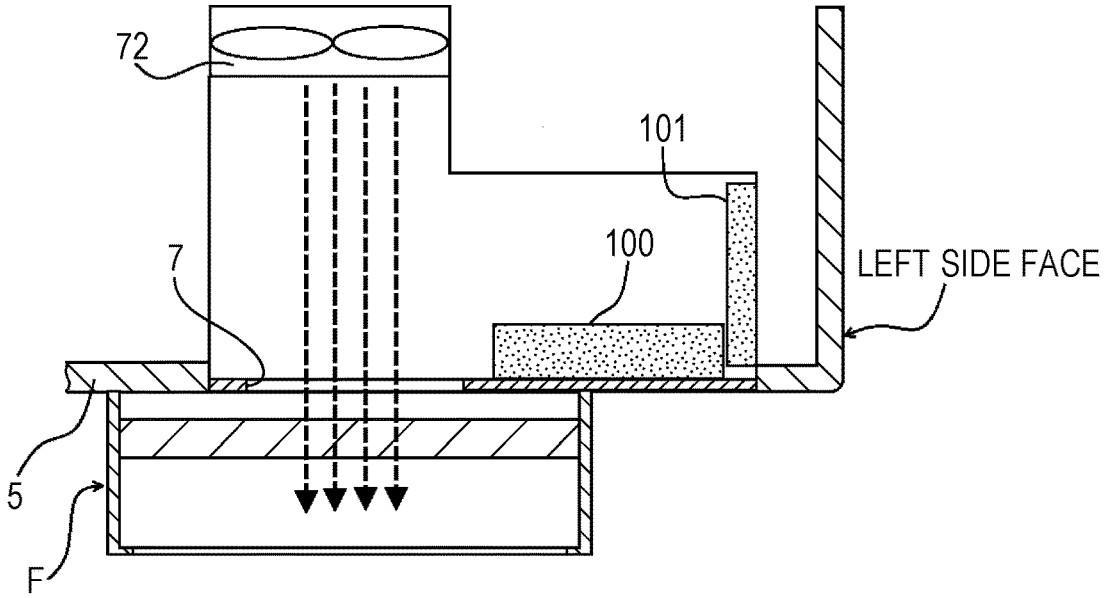
FIG. 7 is a schematic sectional view of the apparatus body and illustrates flows of air in a case where the exterior member is attached thereto in the second mode.

FIG. 4A is a perspective view of the exterior member 6 that is seen from the outer side thereof. FIG. 4B is a perspective view of the exterior member 6 that is seen from the inner side thereof. FIG. 5A is a perspective view of the exterior member 6 that is to be attached to the apparatus body in the first mode. FIG. 5B is a perspective view of the exterior member 6 that is to be attached to the apparatus body in the second mode. FIG. 6 is a schematic sectional view of the apparatus body and illustrates flows of air in a case where the exterior member 6 is attached thereto in the first mode. FIG. 7 is a schematic sectional view of the apparatus body and illustrates flows of air in a case where the exterior member 6 is attached thereto in the second mode.

The configuration and operation of the exterior member 6 will now be described with reference to the drawings.

(2.1) Configuration of Exterior Member

As illustrated in FIG. 4A, the exterior member 6 is a detachable covering generally having a rectangular shape and covers the opening 5*a* provided in one of the exterior covering members 5 forming the apparatus body.

The exterior member 6 has the vent holes 7 on one lateral side thereof. The vent holes 7 are openings through which air to be exhausted from the opening 5*a* of the apparatus body is allowed to flow toward the rear side of the apparatus body.

The exterior member 6 has projections 8 at one end thereof and a grip portion 9 at the other end thereof. The projections 8 and the grip portion 9 are integrally provided to the exterior member 6. The grip portion 9 is elastically deformable and includes an engaging projection 9*a*.

As illustrated in FIGS. 5A and 5B, the exterior covering member 5 that has the opening 5*a* has fitting holes 5*b* and an engaging hole 5*c* on each of two opposing inner sides of the opening 5*a*. The fitting holes 5*b* and the engaging hole 5*c* on one side are arranged symmetrically to the fitting holes 5*b* and the engaging hole 5*c* on the other side.

In a state where the exterior member 6 is positioned with the projections 8 thereof being fitted in corresponding ones of the fitting holes 5*b* provided in the opening 5*a*, the engaging projection 9*a* of the grip portion 9 is fitted into a corresponding one of the engaging holes 5*c* provided in the opening 5*a*. Thus, the exterior member 6 is attached to the exterior covering member 5.

As illustrated in FIG. 4B, the exterior member 6 is provided with a sound absorbing member 100 on the inner side thereof and on the lateral side thereof not having the vent holes 7. The sound absorbing member 100 is made of a soft foam material or an elastically deformable porous material.

If the sound absorbing member 100 is made of sheet-type urethane foam, the sound absorbing member 100 may have an apparent density of about 0.06 to 0.12 g/cm$^3$. To meet a flame retardancy standard (for example, UL-94 HF-1), the sound absorbing member 100 in the form of a sheet member may have a thickness of 13 mm or less.

If the sound absorbing member 100 is made of an elastically deformable porous material, the sound absorbing member 100 may be a sheet member made of any one of glass wool, felt, plant-fiber felt, synthetic-fiber felt, and nonwoven fabric, or a mixture of any of the foregoing materials.

In the first mode called "silent mode," the exterior member 6 configured as described above is oriented such that, as illustrated in FIG. 5A, the vent holes 7 do not directly face the air outlet of the exhaust fan 72.

In the second mode called "productivity-priority mode," the exterior member 6 is inverted upside down and is attached to the apparatus body such that, as illustrated in FIG. 5B, the vent holes 7 directly face the air outlet of the exhaust fan 72.

The projections 8 provided at one end of the exterior member 6 are fittable into the fitting holes 5*b* on either of the two inner sides of the opening 5*a*. The engaging projection 9*a* of the grip portion 9 provided at the other end of the exterior member 6 is engageable with the engaging hole 5*c* on either of the two inner sides of the opening 5*a*.

Therefore, the orientation of the exterior member 6 with respect to the opening 5*a* is invertible upside down.

(2.2) Operation of Exterior Member

As illustrated in FIG. 6, in the image forming apparatus 1 with the exterior member 6 oriented such that the vent holes 7 do not directly face the air outlet of the exhaust fan 72, air heated in the image forming unit 2 and taken into the air duct 71 by the exhaust fan 72 collides with the sound absorbing member 100 provided on the inner side of the exterior member 6.

The air whose speed has been temporarily reduced by being absorbed by the sound absorbing member 100 is redirected to flow along the inner surface of the exterior member 6 in the opening 5*a*. Then, the air collides with another sound absorbing member 101 provided on the inner surface of the opening 5*a*, is redirected toward the rear side of the apparatus body, and is exhausted from the vent holes 7 of the exterior member 6 (see the arrows illustrated in FIG. 6).

Thus, the first mode in which the vent holes 7 of the exterior member 6 do not directly face the air outlet of the exhaust fan 72 is referred to as "silent mode" in which the number of pages to be printed at a time by the image forming apparatus 1 is not so large, as in normal usage, and silence with less noise leakage has priority over productivity.

In the "silent mode," air is not directly exhausted from the apparatus body but is made to collide with the sound absorbing member 100, whereby noise leakage is suppressed. Furthermore, after the air flows in the lateral direction, the air is redirected toward the rear side and is exhausted. Therefore, the length of the passage through which the air flows is longer and the noise generated is smaller than in a case where the air is exhausted directly from the air duct 71.

In contrast, in the image forming apparatus 1 with the exterior member 6 inverted upside down and oriented such that the vent holes 7 directly face the air outlet of the exhaust fan 72 as illustrated in FIG. 7, air heated in the image forming unit 2 and taken into the air duct 71 by the exhaust fan 72 is not redirected and is directly exhausted toward the rear side of the apparatus body through the vent holes 7 of the exterior member 6.

If the number of pages to be printed at a time by the image forming apparatus 1 is large, the temperature in the image forming unit 2 tends to become high. Therefore, air heated in the image forming unit 2 needs to be exhausted quickly to the outside of the image forming apparatus 1. The mode taken in such a case in which high productivity has priority is referred to as "productivity-priority mode."

Depending on the environment in which the image forming apparatus 1 is used, a deodorant member F that removes the odor of the air to be exhausted from the apparatus body may be additionally provided. The deodorant member F may be, for example, an external filter having a honeycomb structure and made of a material, such as active carbon or zeolite, which absorbs the source substance of the odor.

In general, to fully enjoy the effect of removing the odor that is exerted by such an external deodorant member, the deodorant member needs to have an area larger than the cross-sectional area of a passage that leads to the vent holes of the exterior member. In the exemplary embodiment, the deodorant member F is attached to the image forming apparatus 1 with the exterior member 6 oriented in the second mode in which the vent holes 7 directly face the air outlet of the exhaust fan 72.

With the exterior member 6 oriented in the second mode, air in the image forming unit 2 flowing from the air duct 71 and through the exhaust fan 72 directly flows through the vent holes 7 of the exterior member 6 without being redirected, and smoothly passes through the deodorant member F. Thus, the air whose odor has been removed is exhausted toward the rear side of the apparatus body.

In the case where the external deodorant member F is attached to the image forming apparatus 1, the deodorant member F is positioned such that the center thereof coincide with the center of the group of the vent holes 7 of the exterior member 6 that is oriented in the second mode. Therefore, the deodorant member F only extends over a portion of the rear face of the apparatus body and does not project from the left side face of the apparatus body.

In the image forming apparatus 1 according to the exemplary embodiment, the orientation of the exterior member 6 with respect to the opening 5*a* is invertible upside down in accordance with which of the "silent mode" and the "productivity-priority mode" is selected. Hence, there is no need to provide two kinds of exterior members for the two respective modes.

In addition, if the external deodorant member F is attached to the image forming apparatus 1, an exhaust route that allows the deodorant member F to function is provided by orienting the exterior member 6 in the second mode.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body;

an exhaust fan provided in the apparatus body; and an exterior member configured to be attached to the apparatus body in such a manner as to cover an opening of the apparatus body and to be attachable to the apparatus body in both a first orientation and a second orientation, the opening allowing air in the apparatus body to be exhausted outside the apparatus body, the exterior member having a vent hole that allows the air to flow through the exterior member, wherein the exterior member is configured such that:

when it is attached to the apparatus body in the first orientation, the vent hole directly faces the exhaust fan; and when it is attached to the apparatus body in the second orientation, the vent hole does not directly face the exhaust fan.

2. The image forming apparatus according to claim 1, wherein the exterior member has a projection at one end of the exterior member and an elastically deformable grip portion at another end of the exterior member, the grip portion including an engaging projection, and wherein a fitting hole into which the projection is fitted and an engaging hole into which the engaging projection is fitted are provided on each of two opposing sides of the opening.

3. An image forming apparatus comprising:

an apparatus body; and an exterior member attached to the apparatus body in such a manner as to cover an opening of the apparatus body, the opening allowing air in the apparatus body to be exhausted to an outside, the exterior member having a vent hole that allows the air to flow through the exterior member, the exterior member being invertible upside down, wherein the vent hole is provided on one lateral side of the exterior member, and wherein the exterior member is provided with a sound absorbing member on another lateral side of the exterior member, the sound absorbing member being on an inner side of the exterior member, the other lateral side of the exterior member being opposite the one lateral side provided with the vent hole.

4. The image forming apparatus according to claim 3, wherein the sound absorbing member is made of a soft foam material or an elastically deformable porous material.

5. The image forming apparatus according to claim 1, wherein the exterior member is invertible upside down.

* * * * *